United States Patent [19]

Shea

[11] 4,089,444

[45] May 16, 1978

[54] TAPPING APPARATUS FOR GOLDEN GATE TYPE BEER KEG OPENINGS

[76] Inventor: Ronald E. Shea, 643 Oxford Rd., Oxford, Conn. 06483

[21] Appl. No.: 758,202

[22] Filed: Jan. 10, 1977

Related U.S. Application Data

[63] Continuation of Ser. No. 449,712, Mar. 11, 1974.

[51] Int. Cl.[2] ..... B65D 83/00

[52] U.S. Cl. ..... 222/400.7; 137/212

[58] Field of Search ..... 222/400.7, 400.8; 137/212

[56] References Cited

U.S. PATENT DOCUMENTS

| | | | |
|---|---|---|---|
| 3,065,885 | 11/1962 | Chatten | 222/400.7 |
| 3,228,413 | 1/1966 | Stevens, Jr. | 222/400.7 X |
| 3,591,057 | 7/1971 | Johnston | 222/400.7 |
| 3,610,478 | 10/1971 | Johnston | 222/400.7 |
| 3,720,355 | 3/1973 | Johnston | 222/400.7 |
| 3,758,008 | 7/1973 | Johnston | 222/400.7 |

*Primary Examiner*—Allen N. Knowles
*Assistant Examiner*—David A. Scherbel

[57] ABSTRACT

A beer keg tapping apparatus for golden gate type openings comprising a keg unit consisting of a stepped annular member in which valve controlled gas and liquid passages are disposed and which is adapted for insertion into the beer keg through the golden gate opening, and a stepped annular coupling member which is adapted for slidable disposal over the keg unit and includes first and second external threaded portions for engagement with the keg opening for securing the keg unit therein and with a tavern unit for tapping beer from the keg, respectively.

5 Claims, 2 Drawing Figures

TAPPING APPARATUS FOR GOLDEN GATE TYPE BEER KEG OPENINGS

This is a continuation of application Ser. No. 449,712, filed Mar. 11, 1974,

BACKGROUND OF THE INVENTION

1. Field of the Invention

This invention relates generally to beer keg tapping devices, and in particular to an improved tapping apparatus for beer kegs having a "golden gate" type keg opening.

2. Description of the Prior Art

Beer keg tapping devices for both "peerless" and "golden gate" type keg openings are generally well known in the art. See, for example, U.S. Pat. Nos. 3,065,885, 3,228,413, 3,442,448, 3,438,553, 3,527,391, 3,591,057, 3,596,810, and 3,637,117. These patents disclose various keg tapping devices which are adapted for use with either type of keg opening, or both. Generally speaking, those tapping devices which are adapted for use with golden gate type keg openings, and especially those which are interchangeable with both types of openings, are unnecessarily complex in their structure. A simpler structural design facilitates more easy tapping of the beer keg, and is thus preferred over other features of such tapping devices.

SUMMARY OF THE INVENTION

It is therefore an object of the present invention to provide an improved tapping apparatus for golden gate type beer keg openings which is more simple in structural design than heretofore known beer keg tapping devices.

This and other objects of the invention are achieved by the provision of a tapping apparatus for beer kegs having a golden gate type dispensing opening, the latter consisting generally of an annular stepped sleeve integrally formed with the beer keg and including a reduced diameter opening at the axially inner end thereof which is communicative with the keg, an internally threaded portion at the axially outer end thereof, and an intermediate diameter internal smooth bore portion disposed therebetween. The latter portion and the reduced diameter opening define therebetween an annular shoulder at the axially inner end of the sleeve for engagement with and support of a keg unit.

The tapping apparatus of the invention comprises a removable keg unit which is adapted for slidable disposal in the keg, formed as a stepped annular member. The member includes a plurality of external smooth bore portions of different diameter and an annular flange disposed between selected ones of the smooth bore portions, the latter being adapted for engagement with the annular shoulder in the sleeve and support of the keg unit thereon. The annular member is also dimensioned so as to have a diameter at the end thereof inserted into the keg opening which is less than the diameter of the reduced diameter opening of the sleeve. The annular flange of the member has a diameter which is less than that of the intermediate smooth bore portion of the sleeve, and the axially outer end thereof has a diameter less than that of the threaded portion of the sleeve, the latter thus forming a stepped annular space therebetween. The keg unit further comprises a liquid passage opening extending therethrough for draining beer externally of the keg, a gas passage opening extending therethrough for admitting gas to the interior space of the keg, and valve means disposed in the liquid and gas passage openings for opening and closing the passage openings. A separate stepped annular coupling member, which includes a smooth annular stepped bore, is adapted for slidable disposal over the keg unit and engagement with the annular flange. The coupling member has a first external threaded portion for disposal in the annular space formed between the sleeve and the keg unit, which portion engages the internal threaded portion of the sleeve and removably secures the keg unit in the sleeve. The coupling member also includes a second external threaded portion of reduced diameter which is adapted for engagement with a keg tapping unit to secure the latter to the beer keg.

DETAILED DESCRIPTION

Figure 2:
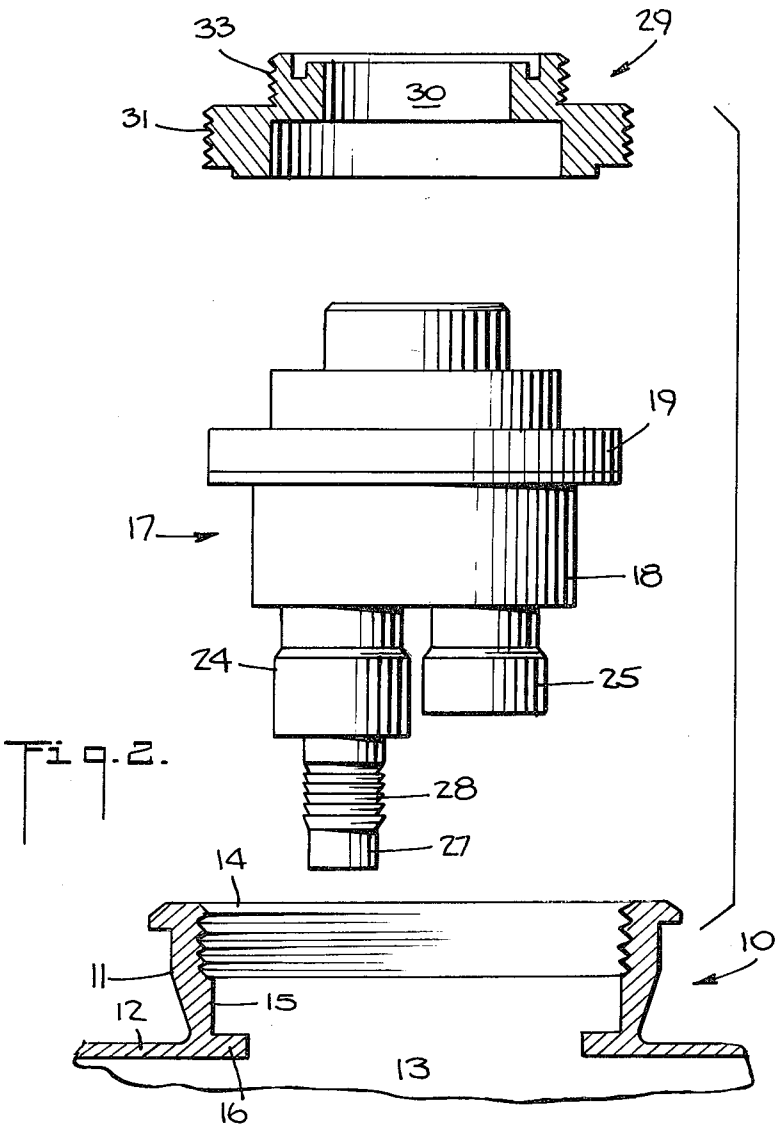
FIG. 2 is an exploded side view of the tapping apparatus showing the keg opening and coupling member of the apparatus in cross-section.
Figure 1:
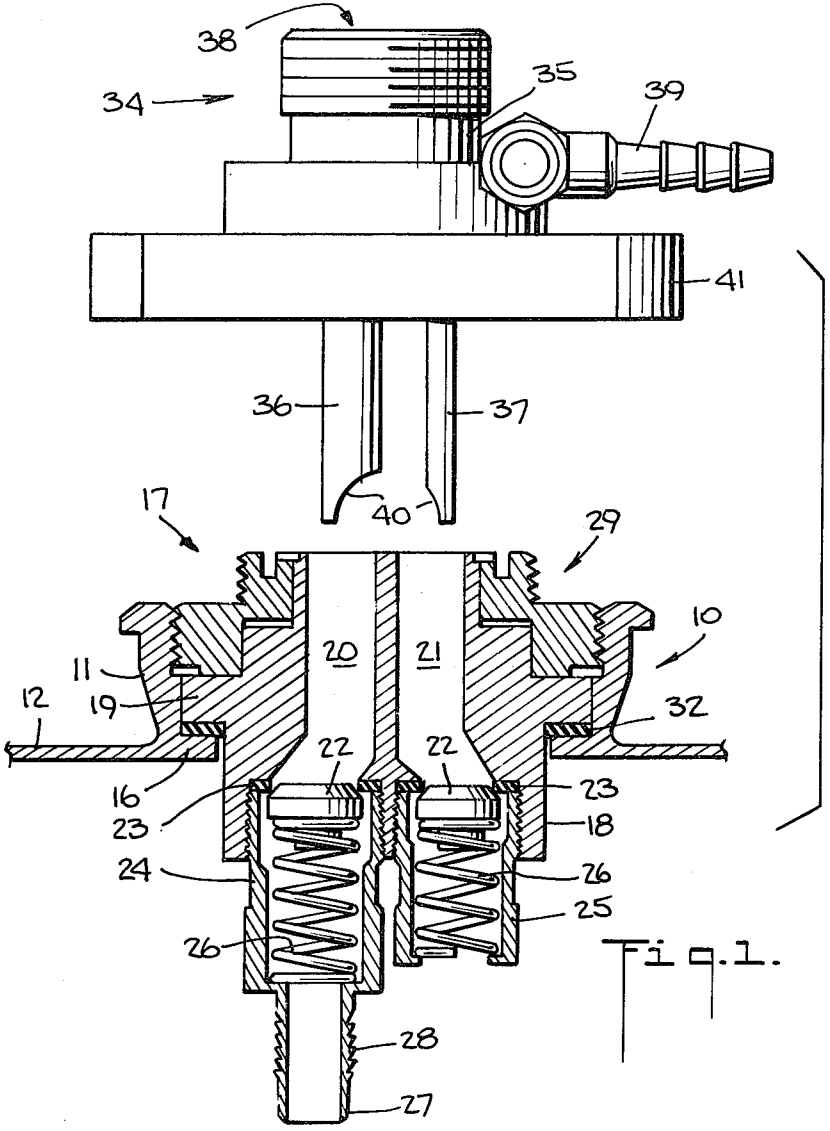
FIG. 1 is a sectional side view of an improved keg tapping apparatus constructed according to the invention illustrating the apparatus as inserted in a keg tapping opening in relation to a keg tapping unit.

Referring now to the drawings, there is shown a golden gate type keg opening, generally designated 10. This opening consists of an annular stepped sleeve 11 which is integrally formed with keg 12, and includes a reduced diameter opening 13 at the axially inner end thereof which opens into the interior space of the keg. An internally threaded portion 14 is provided at the axially outer end of the sleeve. Between portion 14 and opening 13 is disposed an intermediate smooth bore portion 15 of the sleeve which defines in conjunction with opening 13 an annular shoulder 16 at the axially inner end of sleeve 11.

A removable keg unit, generally designated 17, is adapted for slidable disposal into keg opening 10. This unit comprises a stepped annular member 18 including a plurality of external smooth bore portions of different diameter. An annular flange 19 is formed between selected ones of these smooth bore portions, preferably at the approximate axial center of the member 18. The diameter of the axially lower end of member 18, which is inserted into keg 12 through opening 13, is slightly less than the diameter of the keg opening, the latter being standardized at approximately 1½ inches. The diameter of flange 19 is greater than that of opening 13, but is, ad shown in the drawings, slightly less than the diameter of intermediate smooth bore portion 15. The axially outer end of member 18 includes several annular stepped portions, specifically, first and second portions of different diameters, all of which have a diameter which is less than that of threaded portion 14 of sleeve 11 and the opposite, axially inner end of member 18. These several stepped portions form a stepped annular space above flange 19 between member 18 and threaded portion 14 of sleeve 11. Overall, member 18 is configured so that its diameter decreases axially in each direction from flange 19 to the axially inner and outer ends thereof.

The keg unit further includes a liquid passage opening 20 extending axially therethrough through which beer is drained externally of keg 12. A gas passage opening 21 also extends axially through the keg unit and admits gas to the interior space of keg 12 to force beer there-from. Valve means, illustrated as movable valve elements 22, annular valve seats 23, removable valve housings 24 and 25 which are threadably secured in liquid passage opening 20 and gas passage opening 21, respectively, and coil springs 26 disposed in housing 24 and 25, are provided for opening and closing openings 20 and 21. Valve housing 24 also includes a cylindrical extension 27 including a threaded or serrated portion 28 to which a downwardly extending drain tube is connected to assure the removal of all the beer from the keg.

A separate stepped annular coupling member, generally designated 29, forms the other part of the tapping apparatus. This member includes first and second annular portions of different diameter, and a smooth annular stepped bore 30 which is shaped so as to correspond to the external configuration of the smooth bore portions at the axially outer end of member 18 so as to be adapted for slidable disposal over the stepped portions of member 18 and engagement with annular flange 19. Ths coupling member has a first external threaded portion 31 for disposal in the annular space formed between threaded portion 14 of sleeve 11 and member 18 of the keg unit, and engagement with threaded portion 14, and removably secures the keg unit in sleeve 11 to keg 12. An annular gasket seal is interposed between flange 19 and shoulder 16 for sealing opening 13. The coupling member also includes a second external threaded portion 33 of reduced diameter and axial length which is approximately equal to that of threaded portion 14 of sleeve 11, for engagement with and the securement of a tapping unit, described below, to the keg unit. Overall, the coupling member is configured so that its diameter decreases axially from threaded portion 31 to threaded portion 33.

The tapping unit, or as otherwise known, the "tavern unit", is generally designated 34 and is of conventional design. The unit comprises a body member 35 containing separate gas and liquid passage openings (not shown) communicative with a pair of downwardly extending tubular probes 36 and 37 disposed therein and a liquid passage 38 opening at the top of member 35 and a gas pasage opening at the side of member 35, the latter passage being communicative with an air hose coupling flange 39 inserted therein. In the unit illustrated, probe 36 is the liquid passage tapping probe and is communicative with passage 38, and probe 37 is the gas passage tapping probe and is communicative only with flange 39. Both probes are cut away at the lower ends thereof to provide arcuate tips 40 to facilitate entrance of the probes into the lower, offset portions of passage openings 20 and 21 in the keg unit. The axially upper end of body member 35 includes a threaded portion for coupling the member to a connecting flange of a hose or line for conducting beer from the keg to a cooling box or related dispensing equipment. A rotatable flange nut 41 is slidably disposed about member 35 on a radially outwardly extending flange (not shown) provided at the axially lower end thereof, and includes an internally threaded portion (also not shown) which engages threaded portion 33 of coupling member 29. When the tapping unit is secured to the keg unit by means of coupling member 29 and flange nut 41, tips 40 of probes 36 and 37 displace valve elements 22 downwardly in housing 24 and 25, respectively, and ready the keg 12 for tapping in the conventional manner.

To install the keg unit 17 in keg 12 and ready the latter for tapping, the keg unit is simply slipped into opening 13 until gasket seal 32 engages shoulder 16. Coupling member 29 is then screwed into sleeve 11 to anchor unit 17 therein, and tapping unit 34 is attached to the keg by means of flange nut 41. The beer in keg 12 is then withdrawn by admitting pressurized gas to the keg through passage opening 21, which gas forces beer from the keg through passage opening 20. The use of the coupling member of the invention greatly simplifies the structure of the keg unit, which does not require the provision of fastening means integrally formed therewith or attached thereto for securing the keg unit in the keg opening.

In the foregoing specification, the inventive beer tapping apparatus has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A tapping apparatus for beer kegs having a golden gate type dispensing opening, said opening consisting of an annular stepped sleeve integrally formed with said keg and including a reduced diameter opening at the axially inner end thereof communicative with said keg, an internally threaded portion at the axially outer end thereof, and an intermediate diameter internal smooth bore portion disposed therebetween, said smooth bore portion and said reduced diameter opening defining therebetween an annular shoulder at the axially inner end of said sleeve, the tapping apparatus comprising:

a removable keg unit, adapted for slidable disposal into said keg, comprising a stepped annular member including a plurality of external smooth bore portions of different diameter disposed axially along said member and an annular flange disposed thereon between selected one of said portions, said annular member having a diameter at one end thereof for insertion into said keg which is less than the diameter of said reduced diameter opening, said annular flange having a diameter less than that of said intermediate smooth bore portion of said sleeve, with the axially outer end of said annular member having a diameter less than that of said threaded portion of said sleeve and forming a stepped annular space therebetween, said annular flange adapted for movement into sealing engagement toward said annular shoulder, sealing means disposable between said flange and said shoulder to provide a fluid tight seal for said keg unit in said dispensing opening, said keg unit further comprising a liquid passage extending axially therethrough and terminating in an axial opening at each end for draining beer externally of said keg, a gas passage extending axially therethrough and terminating in an axial opening at each end for admitting gas to the interior space of said keg, said liquid passage opening and gas passage opening disposed side by side and valve means disposed in said gas and liquid passages for opening and closing said passages; and a separate stepped annular coupling member, including a smooth annular stepped bore, adapted for slidable disposal over said keg unit and engagement with said annular flange, and having a first external threaded portion for disposal in said annular space between said annular sleeve and said annular member and engagement with said internal threaded portion of said sleeve for removably securing said keg unit in said sleeve, and a second external threaded portion of reduced diameter for engagement with a keg tapping unit, said keg unit being adapted to be held stationary with respect to said keg opening during tightening of said coupling member.

2. The tapping apparatus recited in claim 1, wherein said bore of said coupling member is shaped so as to correspond to the external configuration of said external smooth bore portions at the axially outer end of said stepped annular member.

3. The tapping apparatus recited in claim 2, wherein the diameter of said annular member of said keg unit decreases axially in each direction from said annular flange to said axially inner and outer ends of said annular member, and wherein the diameter of said coupling member decreases axially from said first external threaded portion to said second external threaded portion.

4. The tapping apparatus recited in claim 3, wherein the axial length of said first external threaded portion of said coupling member is approximately equal to the axial length of said internally threaded portion of said sleeve.

5. The tapping apparatus recited in claim 4, wherein said keg unit annular member includes first and second annular portions of different diameter forming the axially outer end thereof above said annular flange, and wherein said coupling member comprises first and second annular portions of different diameter on which said first and second external threaded portions are disposed.

* * * * *